US006478618B2

(12) United States Patent
Wong

(10) Patent No.: US 6,478,618 B2
(45) Date of Patent: Nov. 12, 2002

(54) HIGH RETENTION COAXIAL CONNECTOR

(76) Inventor: Shen-Chia Wong, No. 10, Lane 121, Li-Der Rd., Peito District, Taipei (TW)

( * ) Notice: Subject to any disclaimer, the term of this patent is extended or adjusted under 35 U.S.C. 154(b) by 0 days.

(21) Appl. No.: 09/827,148

(22) Filed: Apr. 6, 2001

(65) Prior Publication Data

US 2002/0146935 A1 Oct. 10, 2002

(51) Int. Cl.[7] ..... H01R 9/05
(52) U.S. Cl. ..... 439/585; 439/877
(58) Field of Search ..... 439/578, 584, 439/585, 877, 879, 882

(56) References Cited

U.S. PATENT DOCUMENTS 3,320,575 A * 5/1967 Brown et al. ..... 439/584
3,437,982 A * 4/1969 O'Keefe et al. ..... 439/578
4,456,324 A * 6/1984 Staeger ..... 439/578
5,061,207 A * 10/1991 Wright ..... 439/578
5,548,088 A * 8/1996 Gray et al. ..... 174/74 R

OTHER PUBLICATIONS

Merriam–Webster's Collegiate Dictionary, Tenth Edition, Copyright 1999.*

* cited by examiner

*Primary Examiner*—Gary Paumen
*Assistant Examiner*—James R. Harvey
(74) *Attorney, Agent, or Firm*—Troxell Law Office PLLC

(57) ABSTRACT

High retention coaxial connector, including a connector incorporating a first slotted sleeve and a first contact spring, and a coupling having a second slotted sleeve and a second contact spring. The mounting of the connector with the coupling will comprises both the first contact spring and the second contact spring to clamp against the central conductor and the aluminum shield of the coaxial cable.

4 Claims, 10 Drawing Sheets

HIGH RETENTION COAXIAL CONNECTOR

BACKGROUND OF THE INVENTION (1) Field of the Invention

This invention provides a high retention coaxial connector, characterized in that when the connector and the coupling are locked in a final lockup position, the compression of a slotted sleeve and slotted spring results in electromechanical integration by the clamping force created by the spring in the slotted sleeve against the aluminum shield and the central conductor of the coaxiable cable.

(2) Description of the Prior Art

In common cable TV systems, wireless TV systems and Collective Antenna TV system it is common practice to run a matter trunk line to the distributor, wherefrom sub-trunk lines feed to user's terminals, so that at these terminals signals transmitted by the TV emission systems are received. It is at the tail ends of coaxial cables that the trunk line is coupled to a cable connector, and in that manner, assembled to the distributor. FIG. 1A illustrates a coaxial connector that is currently in use nowadays. The purpose of the coaxial connector in the main is to secure optimum coupling between the coaxial shield and the connector body, which is prerequisite to the transmission of electric signals. The coaxial connector 100 comprises a connector body 101, a first coupling sleeve 102, screwed onto one end of the body 101, and a second coupling sleeve 103, screwed unto one end of this first coupling sleeve 102. The connector body 101 comprises an annular collar 104, a damper 105 coaxially assembled within the collar 104, as well as moisture-sealing gasket 106 installed between the internal surface of the body 101 and the terminal end of the collar 104. A harness 107 is coaxially installed inside the second coupling sleeve 103, and a contact 108 is coaxially installed inside the harness 107. A wedge 116 is abutted upon the damper 105.

As shown in FIG. 1B, the damper 105 is executed to be an annular member 110, with both sides having several protrusion detents 111, which engages bulging wall 119 on the collar 104, thereby confining the damper 105 in the collar 104. Referring to FIG. 1C, it will be appreciated that coaxially installed into the second sleeve 103 is a contact 108 of which one end, the contact end 112, may be coupled with the distributor to consummate electric connection, whereas another end, being the clamp end 113, is endowed with inner threads 114 in addition to a plurality of grooves 115.

Structured accordingly, what must be done in the first place as the coaxial connector 100 and the cable 200 are to be assembled together, is to have the loose end of the cable stripped so that outer coating 118 is left naked clear of both the aluminum shield and the core leader 117. Next, insert the cable 200 thus prepared into the body 101 of the connector, thirdly, combine the body 101 with the first coupling sleeving 102 by intertwining each other, causing the damper 105 by its interiority to tightly wrap the aluminum shield 116. Fourthly, the body 101 of the connector into which cable 200 has been established is screwed with the second sleeve 102 culminating in having the core leader 117 of the cable inserted into the inner threads 114 of the contact 108. Structured accordingly, the core leader 117 is compelled to wind up secured by the contact 108, and electric connection is consummated.

The foregoing assembly is awkward and cumbersome which invariably lowers or restricts working efficiency on the part of the working staff. Moreover, with the interior part of the damper 105 tightly wrapping up the external part of the aluminum shield 116, in a rigid to rigid encounter, weathering effects or other causes, such as, for example: heat expansion and cold shrinkage, due to climatological change, wind blown vibration, fatigue or material rigidity, can often bring the damper 105 to aluminum shield 116 clamping to lose force, and that eventually will frustrate the good bond between the coaxial shield and the connector body, causing impaired performance of transmission of electric signals, all the more so in dealing with digital transmission services. To prevent that possibility, working technicians on duty will have to clamp tight the connector body 101 against the first coupling sleeve 102 again each year, and then that simply resulting in additional cost expense, and time spent, for that reason it deserves deliberation for other solutions.

In view of the above discussions, the inventor, verily a professional having been engaged in the art for years, had spent time and labor, energy in working for improvement, and has finally brought up this invention, high retention coaxial connector.

SUMMARY OF THE INVENTION

Accordingly, the primary object of the invention is to provide a high retention coaxial connector, with the body of the connector equipped with a first contact spring which will compel the aluminum shield of the cable into electromechanical bonding to thereby assure reliable electric connections.

A further object of the invention is to provide a high retention coaxial connector, in which the body of the connector is internally mounted with a second contact spring which will compel the core leader of the cable that is being worked with into electromechanical integration so as to assure reliable electric conduction.

Referring first of all to FIG. 2, a panoramic view of the longitudinal section of the high retention coaxial connector 1 structured according to the invention, it will be seen that the coaxial connector 1 comprises the connector body 10 and a coupling 20. Referring to FIG. 3, it will seen that said connector body 10 of the connector is composed of a body 11 with a container hole 12 therein, the container hole 12 further contains a threaded bore 13 which is coaxial with an annular member 30, an annular sleeve 40, an annular collar 50, and a moisture-sealing gasket 14.

BRIEF DESCRIPTION OF THE DRAWINGS

Technical measures employed to serve the above mentioned purposes and characteristic features are to be demonstrated by way of examples covered hereinafter with reference to the accompanying drawings in which.

DETAILED DESCRIPTION OF THE PREFERRED EMBODIMENT

Figure 1A:
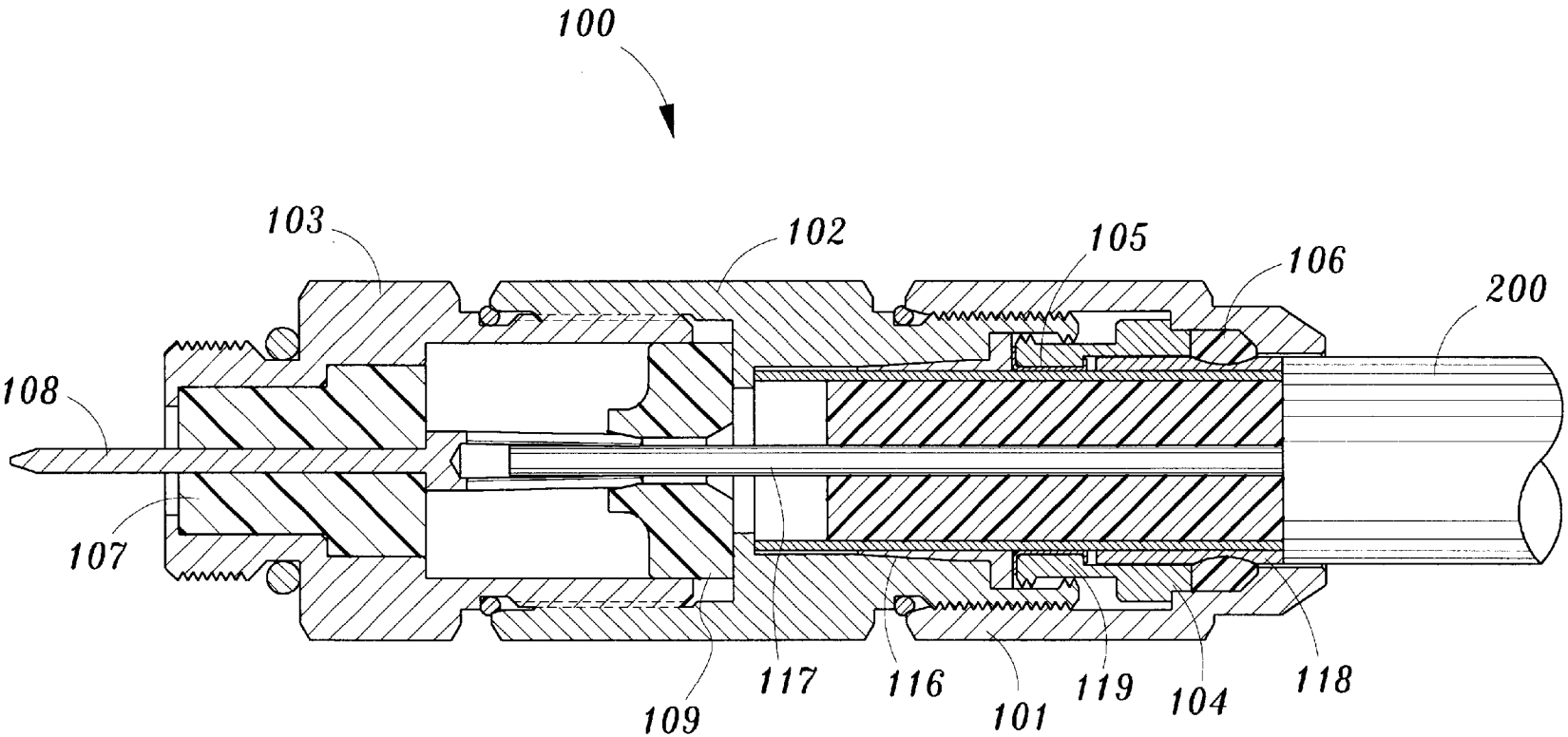
FIG. 1A PRIOR ART
FIG. 1A is a section view of a prior art coaxial cable connector.
Figure 1B:
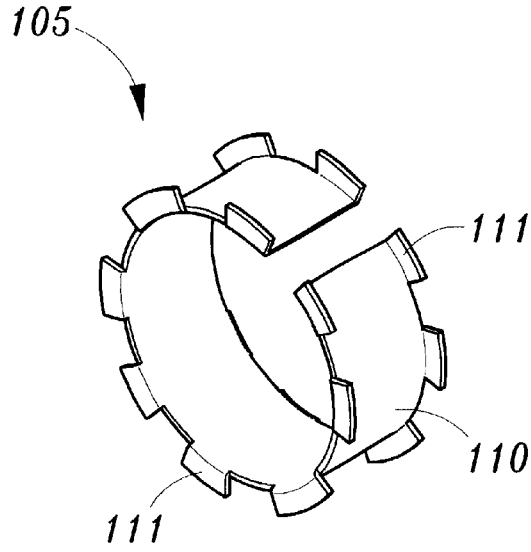
FIG. 1B PRIOR ART
FIG. 1B is a three-dimensional perspective of a prior art clamper.
Figure 1C:
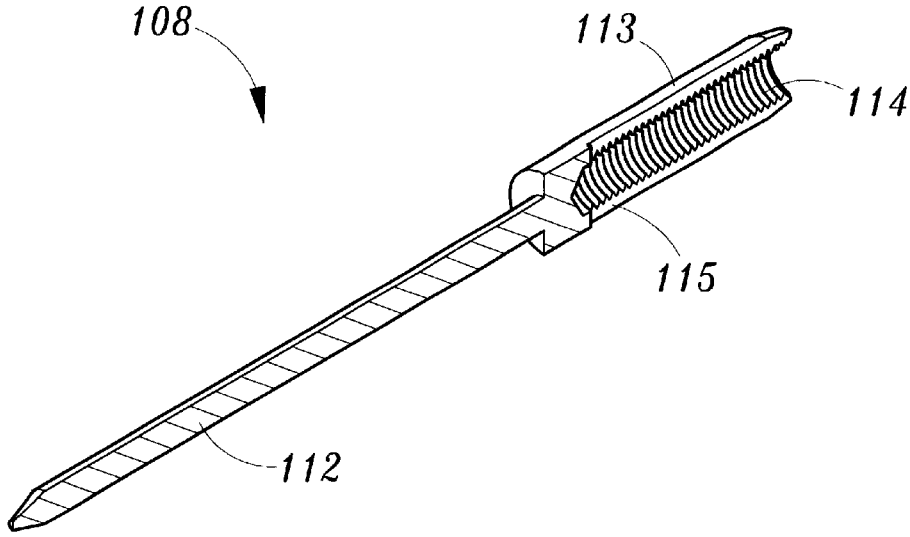
FIG. 1C PRIOR ART
FIG. 1C is a three-dimensional perspective of a prior art contact.
Figure 2:
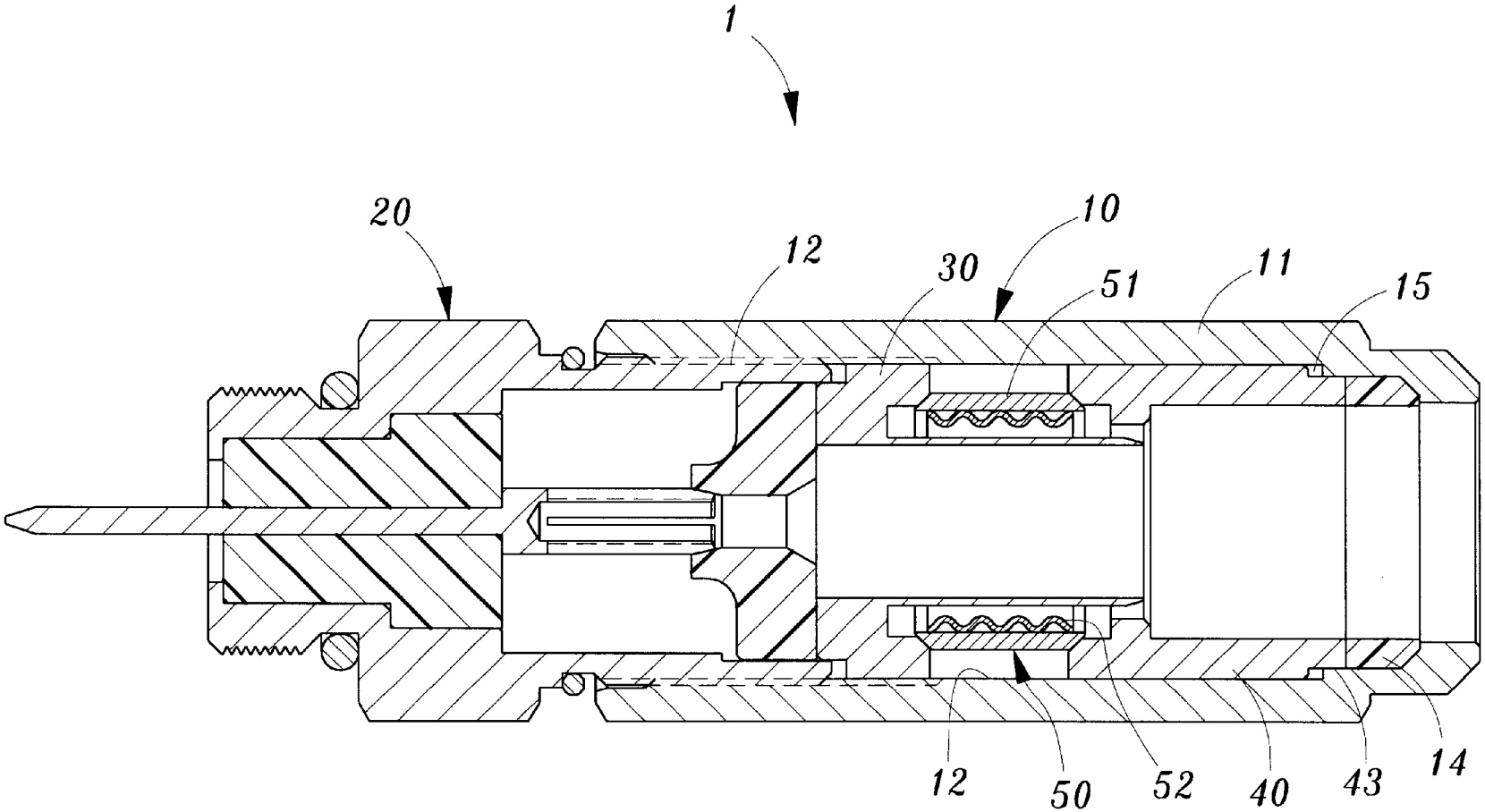
FIG. 2 is a section view of the invention coaxial connector.
Figure 3:
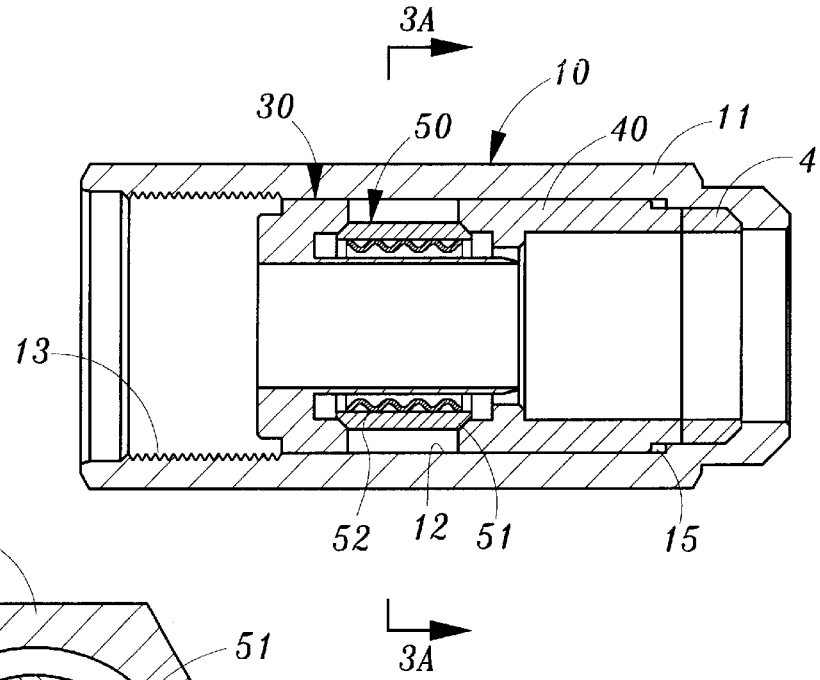
FIG. 3 is a section view of the body of the connector structured according to the invention.

Referring first of all to FIG. 2, a panoramic view of the longitudinal section of the high retention coaxial connector 1 structured according to the invention, it will be seen that the coaxial connector 1 comprises the connector body 10 and a coupling 20. Referring to FIG. 3, it will seen that said conncetor body 10 of the connector is composed of a body 11 with a container hole 12 therein, the container hole 12 further contains a threaded bore 13 which is coaxial with an annular memeber 30, an annular sleeve 40, an annular collar 50, and a moisture-sealing gasket 14.

Figure 4:
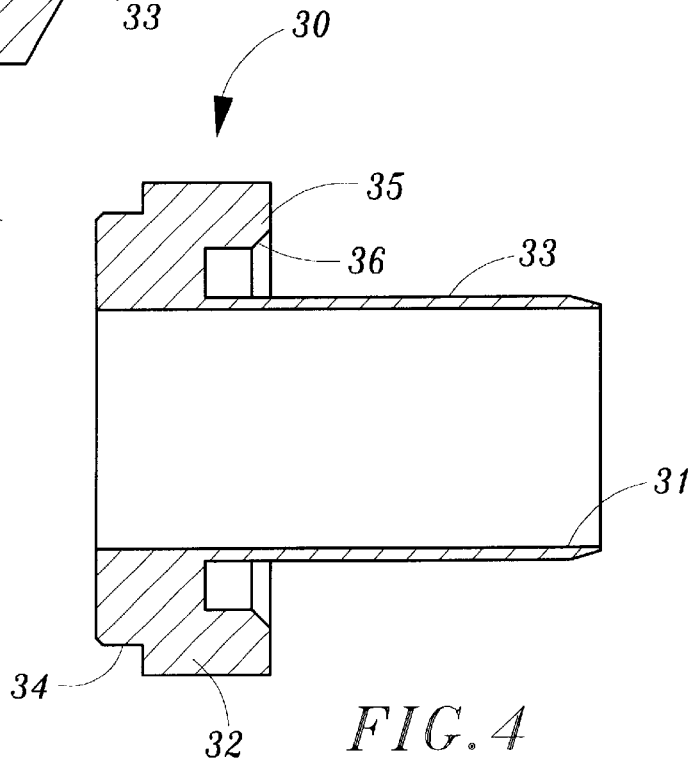
FIG. 4 is a section view of the column part of the invention.
Figure 8:
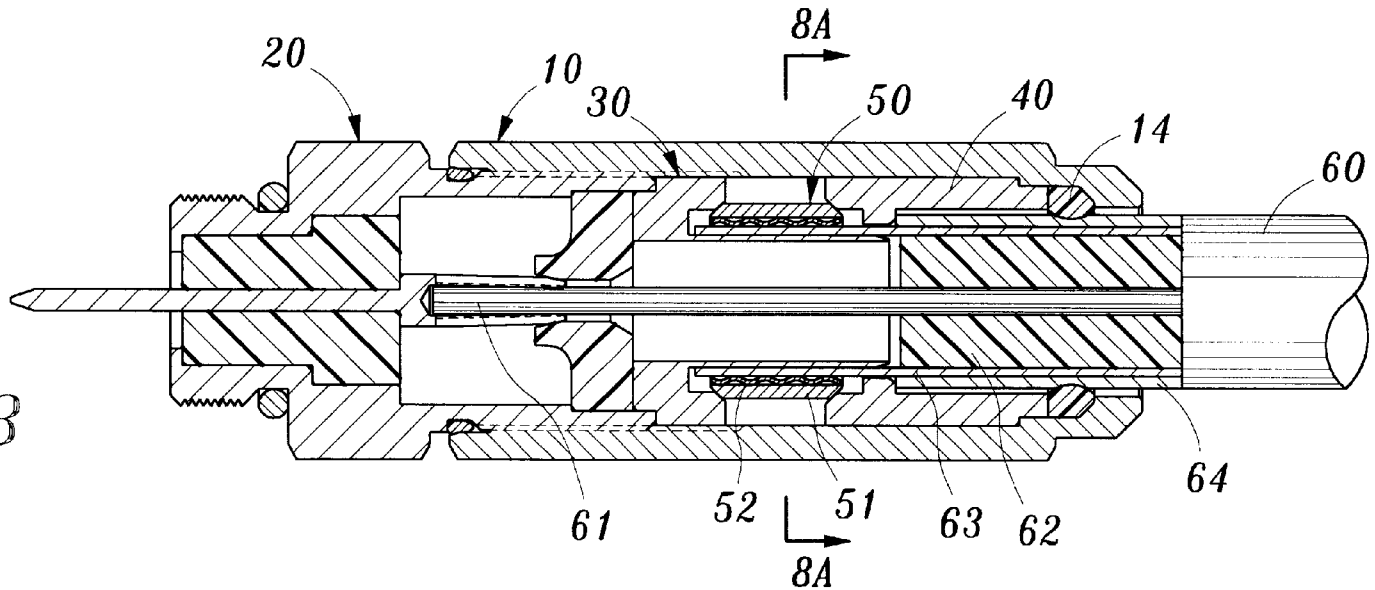
FIG. 8 is a section view of that segment from the lock up through the final position pursuant to FIG. 7.
Figure 8A:
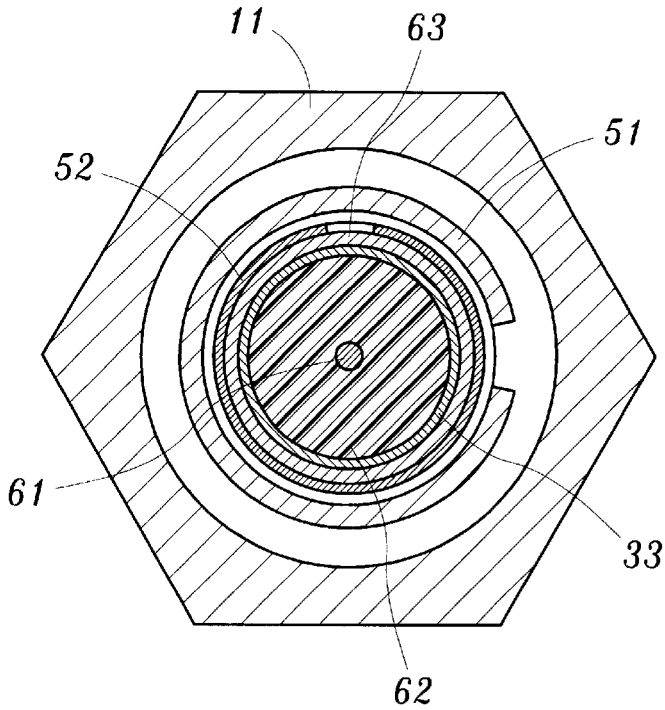
FIG. 8A is a section view of the segment 8A—8A taken from FIG. 8.

Represented by the section view of FIG. 4 is an example of the annular member 30 which is preferably made from metals, and is penetrated by hole 31 whose dia. just accommodates the insulator 62 for the coaxial cable 60, as would be better appreciated by referring to FIG. 8. The annular member 30 has a flange 32 and a pipe section 33. The flange 32 is configured with an annular shoulder 34 and an annular rim 35 which is tapered at 36 within.

Figure 5:
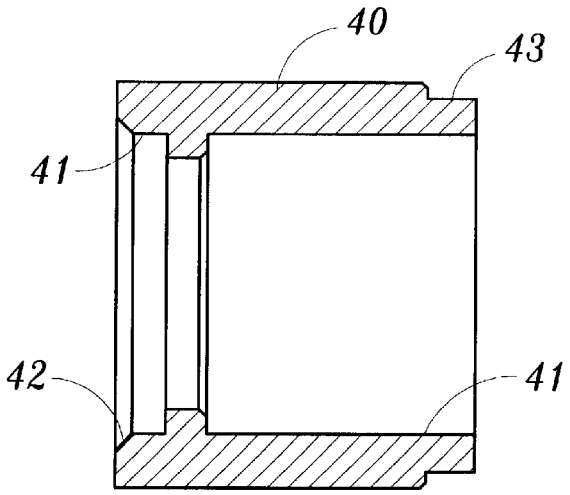
FIG. 5 is a section view of the pipe element of the invention.

Represented in the cross section view of FIG. 5 is an example of the annular sleeve 40, which is preferably made from metals complete with a hole 41 whose end forms a conic section 42. On the end outside of the annular sleeve 40 there is formed an annular shoulder 43 which is spaced apart from the interior of the body 11 by a gap 15.

Figure 3A:
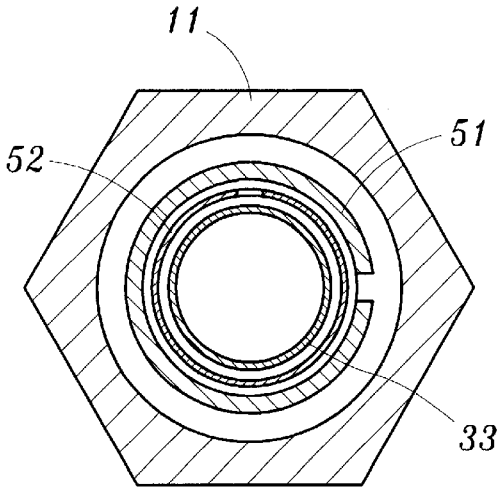
FIG. 3A is a section view of what is pursuant to the line segment 3A—3A as given in FIG. 3.
Figure 6A:
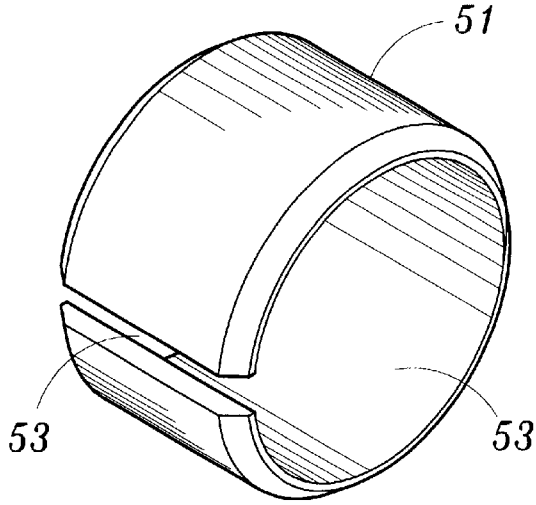
FIG. 6A is a section of the toggle of the invention.
Figure 6B:
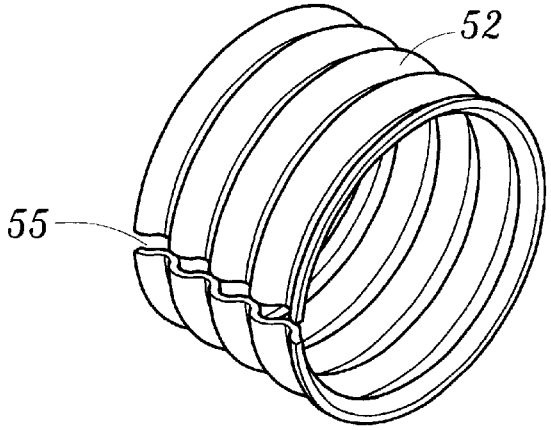
FIG. 6B is a three-dimensional perspective of the contact spring of the invention.

As shown in FIG. 3, FIG. 3A, the annular collar 50 is mounted between the annular member 30 and the sleeve 40, and incorporates a slotted sleeve 51 and a first contact spring 52. Represented in the three-dimensional view of FIG. 6A is an example of the slotted sleeve 51 which incorporates a hole 53 whose dia. is such that it will just accommodate the contact spring 52. On the slotted sleeve 51 is formed a slot 53 to allow for flexibility deformation of the slotted sleeve 51. As shown in FIG. 6B, the first contact spring 52 is made from metal base such as, for example, resilient steel, structured by a series of annular rings, and on said first contact spring 52 is formed a slot 55 so as to exhibit a flexible retention force. The first contact spring 52 has an inner dia. sized to accommodate the aluminum shield 63 of the cable (reference called to FIG. 8).

Figure 7:
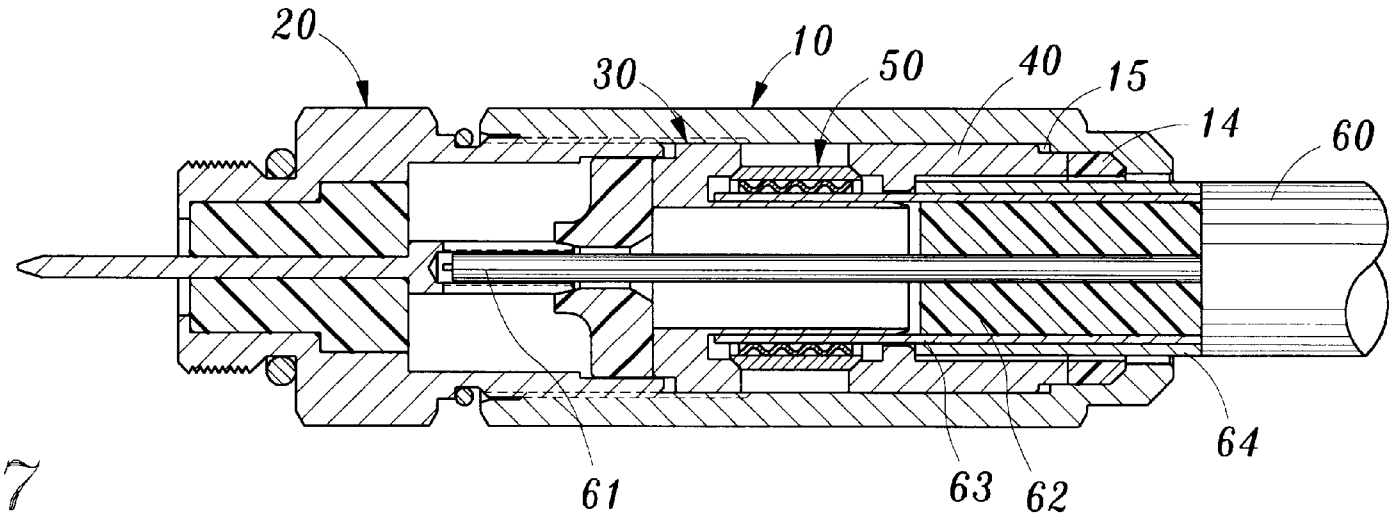
FIG. 7 is an illustration of the invention seen from the body of the connector, the body of the coupling means, the cable lockup through approximation to the final position.

In both FIG. 7, FIG. 8 are represented altogether an example of the high retention coaxial connector 1 in combination with a coaxial cable 60. The cable 60 consists of a central conductor 61, insulator 62, aluminum shield 63 and a hard coating 64. As a first step, prepare the free end of the coaxial cable 60, next, slide the connector as a whole 10 onto the cable 60. As a third step lock up the connector body 10 with the coupling 20 such that as both of them are approach the final positions, the coupling 20 will compel the annular member 30, the sleeve 40, and the annular collar 50 in the connector body 10 to move toward the other end, as would be better appreciated by referring to FIG. 7. By then the sleeve 40 will fill up the gap 15.

When both the connector body 10 and the coupling 20 are established in the final lockup position, the very fact that the moisture-hermetic gasket 14, duly compressed by the pipe element 40, will form a moisture-hermetic seal (see FIG. 8), while the annular collar 50, duly compressed by the annular member 30 in conjunction with the sleeve 40, will bring about a radial contraction of the slotted sleeve 51, the same radial contraction will subject the first contact spring 52 into a tight clamping, albeit flexible, of the aluminum shield 63 of the coaxial cable 60, to assure prolonged and reliable electric conduction or connection (see FIG. 8). As the final step, the central conductor 61 of the coaxial cable 60 is inserted into the contact of the coupling 20, to consummate transmission of electric signals.

Figure 9:
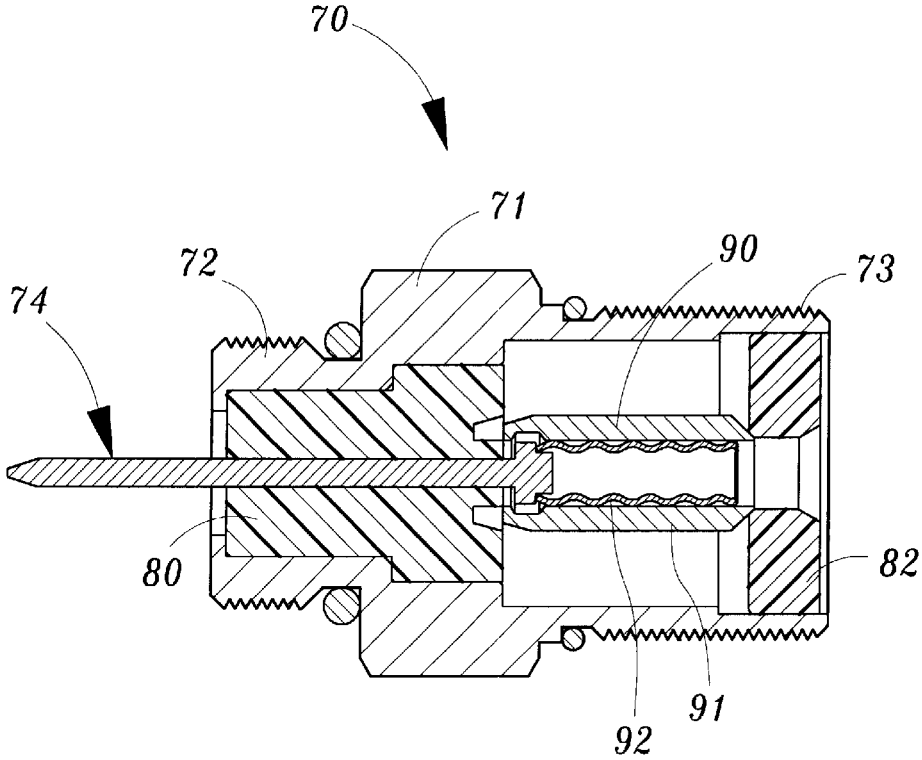
FIG. 9 is a section view of the body of the coupling means of the invention

Represented in the section view of FIG. 9 is an example of a coupling 70 which comprises: coupling body 71, a first insulator 80 arranged within, a second insulator 82 arranged on the other end of the coupling body 71, a contact 74 coaxially arranged in the first insulator 80, plus an annular collar 90 arranged between the first insulator 80 and the second insulator 81. The terminal ends on the outer side of the coupling body 71 is furnished with threads 72, 73; with threads 72 being helically coupled to electronic implements, and threads 73 helically coupled to the connector body 10 (see FIG. 14).

Figure 10:
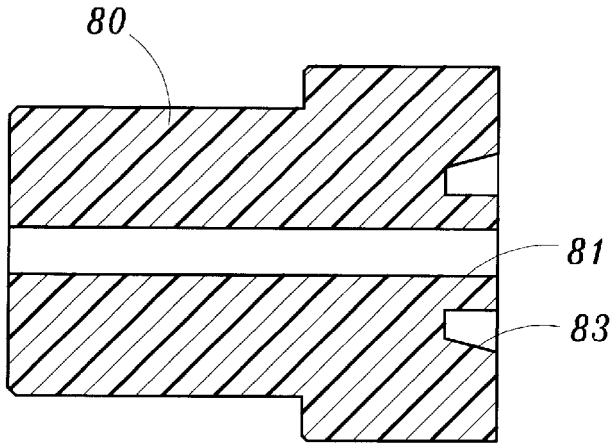
FIG. 10 is a section view of the first insulator pursuant to the invention.

Represented in the section view of FIG. 10 is an example of the first indicator 80 which is penetrated by a hole 81 whose dia. is dimensioned to just accommodate the contact 74. On the edge front of the first insulator 80 is formed an annular groove 83.

Figure 11:
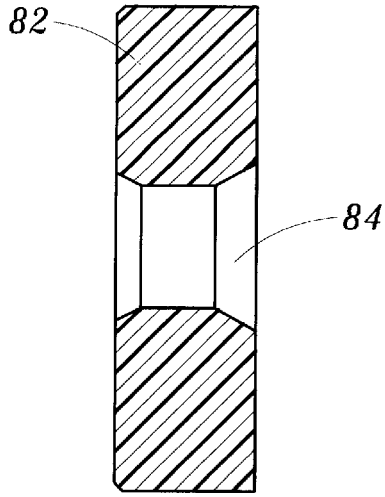
FIG. 11 is a section view of the second insulator pursuant to the invention.

Represented in the section view of FIG. 11 is an example of the second insulator 82 which has an insert hole 84 to accommodate the central conductor 61 of the cable 60.

Figure 12:
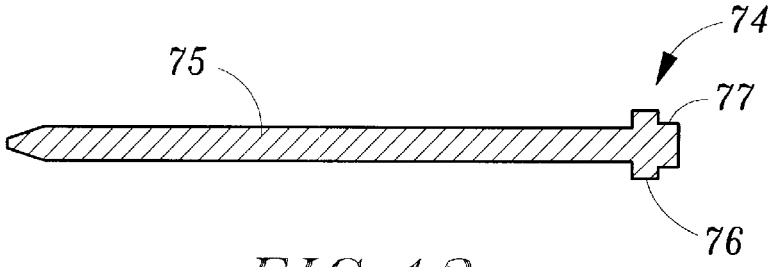
FIG. 12 is a section view of the contact element of the invention.

Represented in FIG. 12 is an example of the contact 74, which consists of a contact piece 75, a flange 76 and an annular shoulder 77.

Figure 13A:
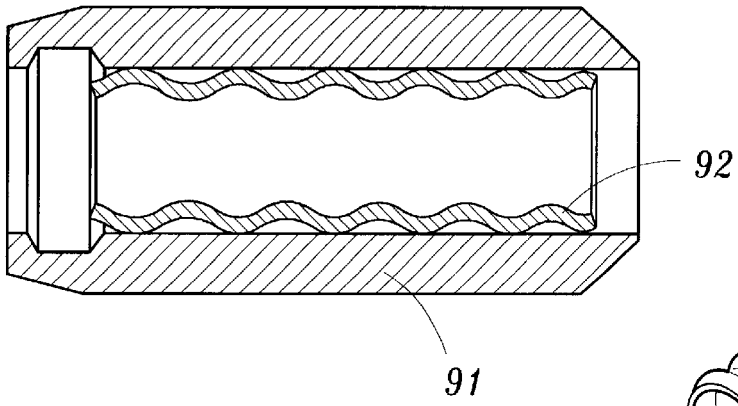
FIG. 13A is a section view of the annular collar of the invention.
Figure 13B:
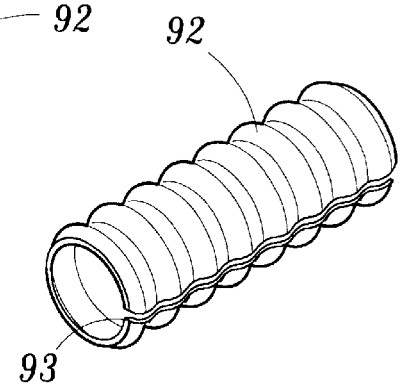
FIG. 13B is a section view of the contact spring of the invention.

Represented in FIG. 13A, in a section view, is an example of the annular collar 90 which consists of a second slotted sleeve 91 and a second contact spring 92 that is coaxially arranged therein. In the three-dimensional perspective of FIG. 13B is an example of the second contact spring 92 comprising a plurality of annular rings connected in series, which is formed a slot 93 serving to yield a forcible but resilient clamping force. At one of its ends the second contact spring 90 is united to the annular shoulder 77 of contact 74 (see FIG. 14).

Figure 14:
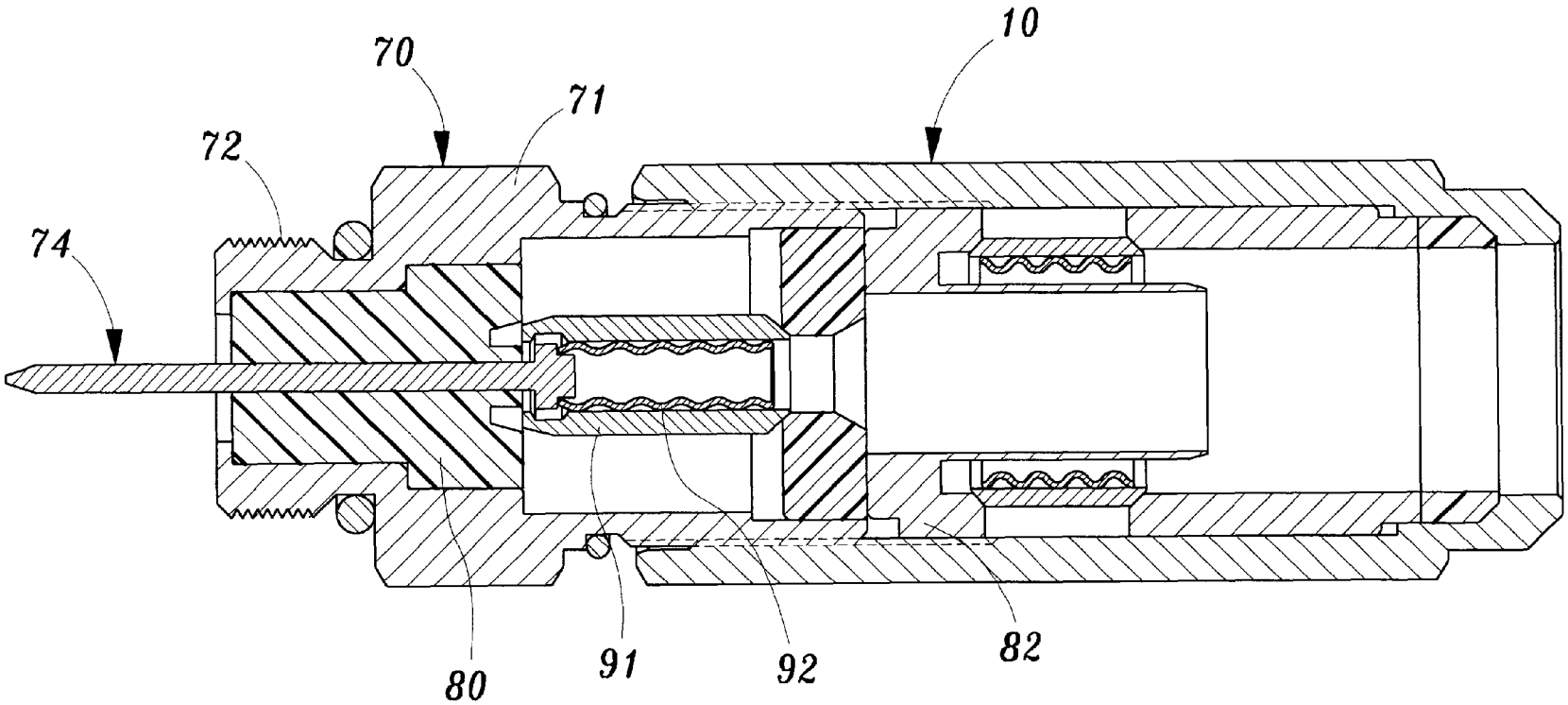
FIG. 14 is a section view of the coaxial connector of the invention.
Figure 15A:
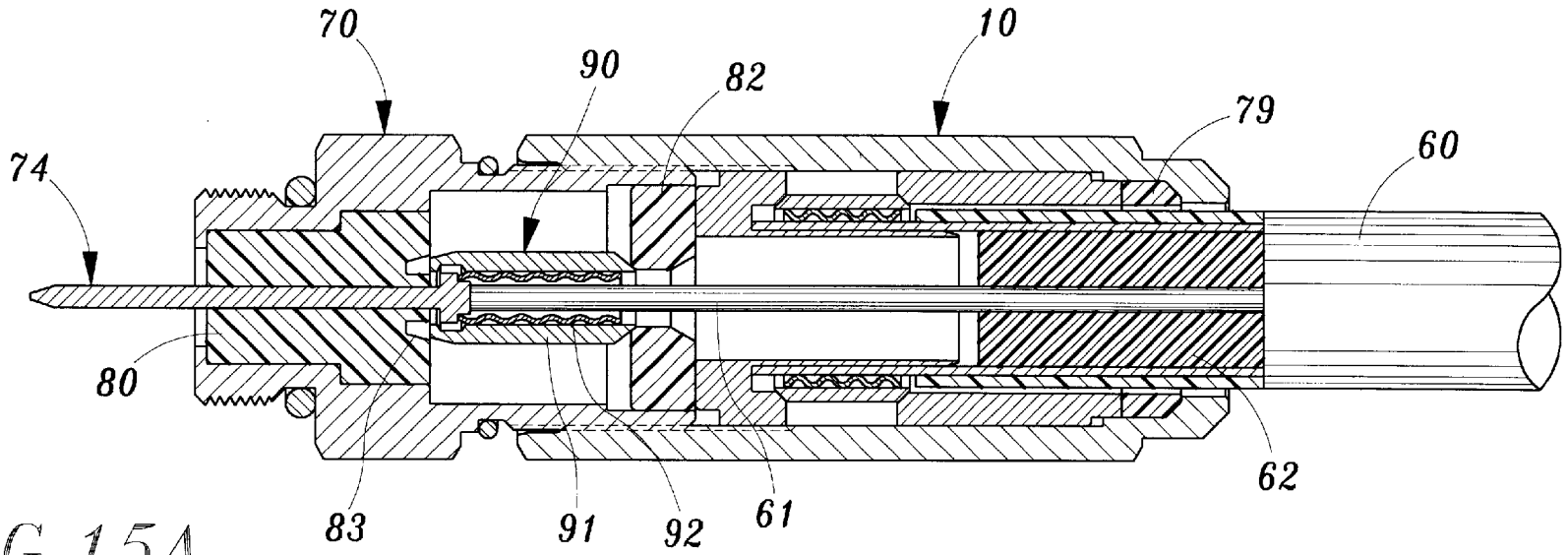
FIG. 15A is an illustration of the invention in going from the body of the connector, the body of the coupling means, and the cable locked up to approximate the final position.
Figure 15B:
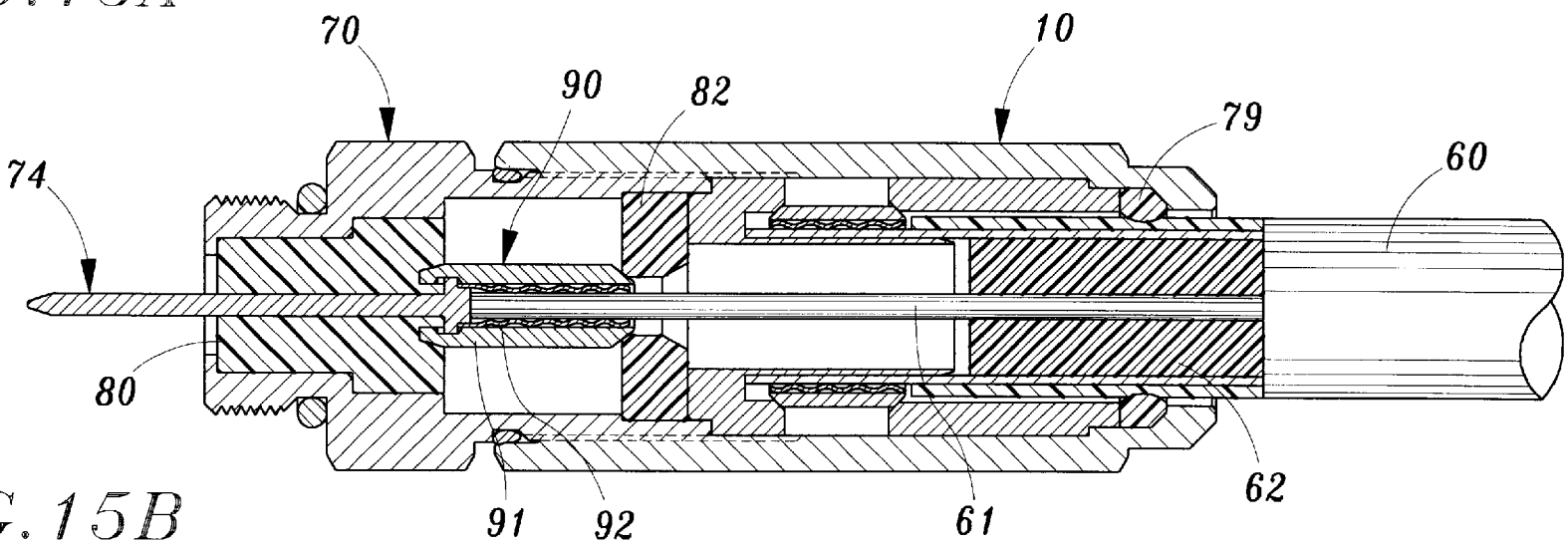
FIG. 15B is a section view of consummation of lockup to the final position pursuant to the illustration of FIG. 15A.

Represented in the section view of FIG. 14 is an example of the invention with the coupling 70 being locked up with the connector 10. Referring to the section views of both FIG. 15A and FIG. 15B, representing altogether one instance whereof the coaxial cable 60 pursuant to FIG. 14 is integrated, the working procedure starts with preparing the free end of the coaxial cable 60, the next being to slide the connector 10 into the cable 60, followed, thirdly, by locking up the connector 10 with the coupling 70. As both the connector 10 and the coupling 70 are being locked to the point of approaching the final positions, the moisture-sealing gasket 79 will be duly compressed to a accomplishing the moisture-hermetic sealing, while one end of the second slotted sleeve 91 engages the annular groove 83, until the terminal of the central conductor 61 contacts the contact 74. By then, the central conductor 61 of the cable 60 is inserted in the second contact spring 92, which is being compressed by both the first insulator 80 and the second insulator 82. The annular collar 90 will force the second split sleeve 91 to shrink radially, such radial contraction will compel the second contact spring 92 into exerting a flexible but tight clamping force on the central conductor 61 of the coaxial cable 60, serving to assure a prolonged and secure electric conduction or connection.

Summing up the disclosure going thus in the foregoing it can be appreciated that with the central conductor 61 of the coaxial cable 60, together with the aluminum shield 63 are simultaneously subjected to compressed albeit flexible clamping by the first and the second contact springs 52, 92. A desired optimum electromechanical bonding is consummated sufficient to warrant a prolonged and reliable electric conduction. The connector and the coupling will suffice to modulate both the first and the second contact springs 52, 92 to apply tight clamping with respect to the aluminum shielding as well as to the central conductor of the cable.

The disclosure going thus far, together with drawings and examples covered hereinbefore, serve but as several embodiments of the invention but by no means to restrict the invention; and it shall be such that all and any modifications, variants, changes made with respect to the invention disclosed herein, to the extent practicable by parties and persons skilled in the art shall nonetheless be deemed within the scope of the invention as defined precisely in the claims following next in the text.

What is claimed is:

1. A high retention coaxial connector comprising:

a) a connector including: a connector body; an annular member movably located in the connector body, the annular member having a hole therethrough, a pipe section and a flange; an annular sleeve located within the connector body; a first slotted sleeve located within the connector body axially between the annular member and the annular sleeve, the first slotted sleeve having a first longitudinal slot; and a first contact spring having a first longitudinal spring slot, the first contact spring located within the first slotted sleeve whereby relative axial movement between the annular member and the annular sleeve causes radial contraction of the first slotted sleeve and the first contact spring causing the first contact spring to clamp an annular shield of a coaxial cable inserted therein; and, b) a coupling engaged with the connector body and including: a first insulator within the coupling; a contact mounted in the first insulator; a second insulator movably located in the coupling and spaced from the first insulator; a second slotted sleeve located within the coupling between the first and second insulators, the second slotted sleeve having a second longitudinal slot therein; and a second contact spring located within the second slotted sleeve, the second contact spring having a second longitudinal spring slot, whereby relative axial movement between the first and second insulators causes radial contraction of the second slotted sleeve and the second contact spring causing the second contact spring to clamp a central conductor of the coaxial cable.

2. The high retention coaxial cable connector of claim 1 further comprising inter-engaging threaded portions on the connector and the coupling whereby the coupling is engaged with the connector.

3. The high retention coaxial cable connector of claim 1 wherein at least one of the first and second contact springs comprises a plurality of annular rings.

4. The high retention coaxial cable connector of claim 1 further comprising an annular groove in the first insulator engaged by an end of the second slotted sleeve.

* * * * *